US005375816A

United States Patent [19]

Ryan et al.

[11] Patent Number: 5,375,816

[45] Date of Patent: Dec. 27, 1994

[54] SLAG DETECTING DEVICE AND METHOD

[75] Inventors: Robert E. Ryan, Highland Heights; Donald O. Bolger, Warren, both of Ohio

[73] Assignee: WCI Steel Corporation, Warren, Ohio

[21] Appl. No.: 153,573

[22] Filed: Nov. 16, 1993

[51] Int. Cl.[5] ..... B22D 11/10; C22B 4/00

[52] U.S. Cl. ..... 266/44; 75/582; 75/584; 266/78

[58] Field of Search ..... 266/44, 78; 75/582, 75/584

[56] References Cited

U.S. PATENT DOCUMENTS

| | | | |
|---|---|---|---|
| 4,037,761 | 7/1977 | Kemlo | 222/590 |
| 4,100,959 | 7/1978 | Guiner | 75/584 |
| 4,150,974 | 4/1979 | Kemlo | 75/60 |
| 4,173,299 | 11/1979 | Kouberg | 222/594 |
| 4,478,392 | 10/1984 | Fuzii | 266/44 |
| 4,583,717 | 4/1986 | Hasegawa | 266/44 |
| 4,880,212 | 11/1989 | Hägglund | 266/94 |
| 5,185,031 | 2/1993 | Lauf | 266/78 |
| 5,250,103 | 10/1993 | Yamauchi | 75/584 |

OTHER PUBLICATIONS

"Electromagnetic Slag Detection in Metallurgical Vessels" by Edmund Julius.

"A Steel Quality Leppfrog—Detection and Elimination of Ladle-To-Tundish Slag Carryover" By Danby.

*Primary Examiner*—Peter D. Rosenberg

*Attorney, Agent, or Firm*—Oldham, Oldham & Wilson Co.

[57] ABSTRACT

A device for detecting slag in molten metal comprises a ladle shroud with a hollow passage that communicates a ladle containing the molten metal to a tundish to allow the molten metal to flow from the ladle to the tundish, and an electrically conductive element positioned in a wall of the hollow passage, so that the element is in electrical contact with the molten metal. If the ladle shroud is electrically conductive, the electrically conductive element is electrically isolated therefrom by an insulating sleeve around the electrically conductive element. Preferably, the electrically conductive element is a steel pin, particularly one where the steel pin has an flanged end in electrical contact with said molten metal, and more particularly where opposite end has a bore therein to accommodate an electrical lead wire to communicate the pin to a voltmeter. To detect the slag, the electrically conductive element is communicated to a voltmeter to compare the electrical potential of the molten metal to a ground potential. The electrical potential of the molten metal will change dramatically as the slag approaches the electrically conductive element.

11 Claims, 1 Drawing Sheet

SLAG DETECTING DEVICE AND METHOD

The present invention relates to a device for detecting the slag in the molten metal of a continuous casting process. More specifically, it relates to a device for detecting such slag in the ladle shroud portion of such a casting process. The present invention also relates to a method of using such a slag detector in a continuous steel casting process.

BACKGROUND ART

The continuous casting of steel product is a technology that has been developed within the last 30 years. In continuous casting, a molten charge of steel is prepared in a ladle vessel that is moved into the proximity of the continuous casting device. Slag is inherently present in the steel-making process. This slag floats to the top of the molten steel in the ladle due to it's lower density. The slag generally comprises the various iron oxides: ferrous oxide (FeO); ferric oxide ($Fe_2O_3$); and ferroferric oxide ($Fe_3O_4$). When the ladle is positioned, the molten steel is drained from the bottom of the ladle through a channel called a ladle shroud into a tundish. The tundish acts as both a reservoir and a manifold for feeding the continuous casting molds.

Molten steel enters the top of the tundish and is fed out of the bottom of the tundish through one or more pipes into molds where a slab of steel is formed and continuously pulled away for further processing. As successive ladles of molten steel are brought into position and then ultimately removed, the tundish serves as the reservoir that allows the molding process to operate continuously.

The economic advantages of continuous casting can be realized only when successive ladles of molten steel are charged to the process without introducing any slag into the product but also without leaving steel in the ladle. Therefore, it is important to detect the presence of slag in the ladle shroud and, once slag is detected, to close the gate valve feeding molten steel from the ladle into the ladle shroud so that the ladle may be replaced.

Molten steel and steel slag exhibit dramatically different electromagnetic properties, so past attempts to detect the presence of slag have relied upon this and used an electromagnetic coil. The use of a coil has unfortunately not provided the desired accuracy.

Another method of detecting the presence of slag is to allow a certain amount of slag to enter the tundish, where the eruption of the slag from the bottom of the ladle shroud can be visually observed due to what is known as the "volcano effect." As with any visual technique, however, it is subject to the subjective judgment of a human viewer, also the attention of a human viewer, both of which are unfortunately unreliable.

SUMMARY OF THE INVENTION

It is, therefore, an object of the present invention to provide a device for detecting the presence of slag in molten steel in a continuous casting process as the molten steel flows from a ladle into a tundish.

This and other objects of the invention are met by a device for detecting slag in molten metal, where the device comprises a ladle shroud with a hollow passage that communicates a ladle containing the molten metal to a tundish to allow the molten metal to flow from the ladle to the tundish, and an electrically conductive element positioned in a wall of the hollow passage, so that the element is in electrical contact with the molten metal. If the ladle shroud is electrically conductive, the electrically conductive element is electrically isolated therefrom by an insulating sleeve around the electrically conductive element. Preferably, the electrically conductive element is a steel pin, particularly one where the steel pin has an end in electrical contact with said molten metal, and more particularly where the end is flanged to increase electrical contact area with the molten metal. To detect the slag, the electrically conductive element is communicated to a voltmeter to compare the electrical potential of the molten metal to a ground potential. The electrical potential of the molten metal will change dramatically as the slag approaches the electrically conductive element.

BRIEF DESCRIPTION OF THE DRAWINGS

A better understanding of the present invention will be had when reference is made to the accompanying drawings, wherein identical parts are identified by identical part numbers and wherein.

DETAILED DESCRIPTION OF THE DRAWINGS

Successful continuous casting is predicated upon the performance of the casting facility to maximize productivity and quality. Productivity is the expectation to successfully cast all of the liquid metal arriving at the casting machine from the liquid steel producing facility. Quality performance is based upon the ability to convert all of the liquid steel into product that arrives at the rolling mill without defects and/or defect-producing structures.

One major deterrent to optimum casting success is the mixing and entrapment of the ladle, tundish, or mold covering slags into the cast product. These various slags are used to prevent steel temperature loss, absorb nonmetallic inclusions present in the molten steel, and to enhance castability of the molds. These slags are nonmetallic and are defects and sources of defects if they should appear in the east product.

The slag coveting the steel in the ladle is especially harmful to the casting process if it should be drained from the ladle into the tundish of the casting process. The ladle slag, a combination of Basic Oxygen Furnace ("BOF") slag and the slags added in the ladle refining operation before casting to enhance the steel making process, is also used as a covering to prevent steel temperature loss in the ladle. Ladle slag is erosive and any slag that gets into the tundish causes a violent action that destroys the refractory coating in the tundish in a very short time. The violent mixing of the nonmetallic ladle slag and the liquid metal in the tundish causes the ladle slag to be transported into the casting molds and end up as a quality defect in the cast product. Ladle slag mixing with liquid steel and tundish slag contributes to shroud and nozzle blocking that reduces the productivity of the casting machine.

Figure 1:
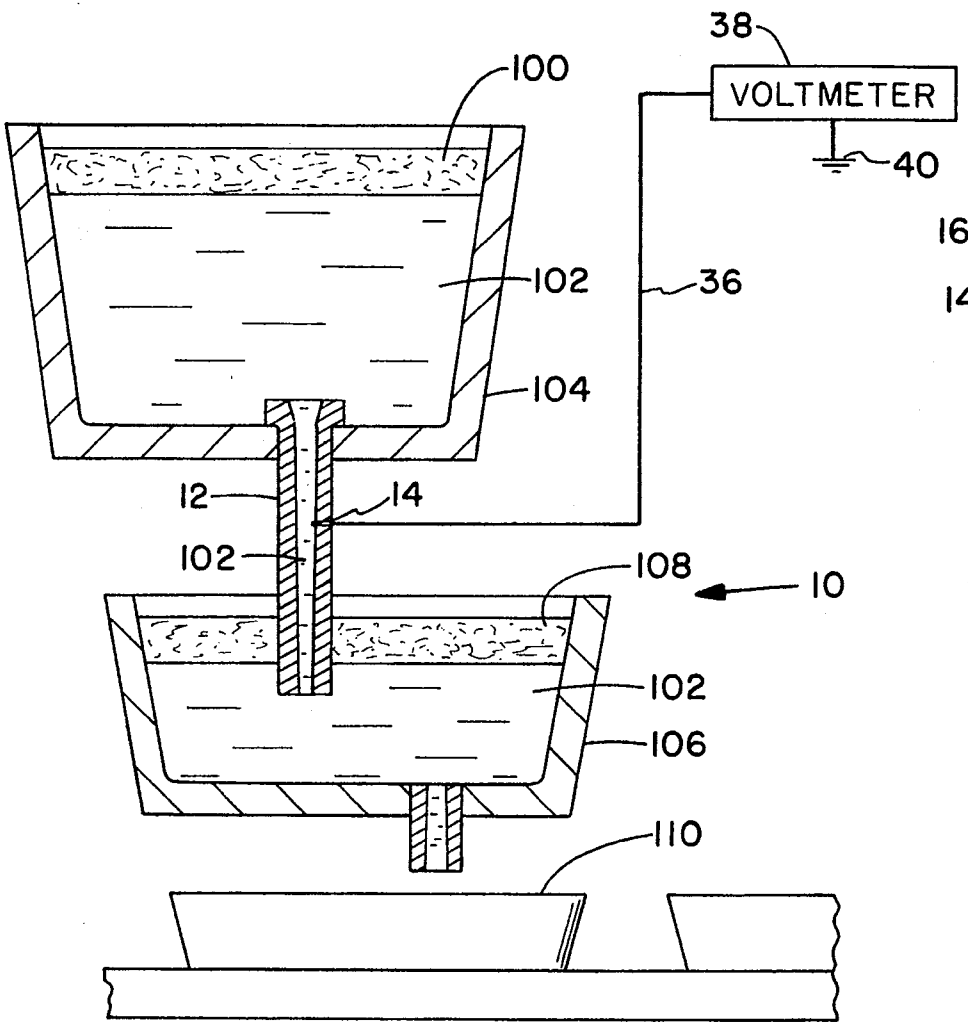
FIG. 1 shows a sectional view of the typical continuous casting operation with the ladle shroud of the present invention.

The overall environment comprising the continuous casting operation 10 is shown in sectional view in FIG. 1. The ladle slag 100 is normally three to five inches thick, riding atop the molten steel 102 in the ladle 104. This ladle slag 100 can enter the tundish 106 if the flow of molten steel 102 is not stopped before the slag 100 reaches the bottom of the ladle 104. Ladle slag 100 can also vortex into the tundish 106 when the molten steel level in the ladle 104 is less than fifteen inches deep. The present manual technique to detect ladle slag 100 is to have the ladle deck operator watch for the appearance of slag entering the tundish 106. When this occurs, a "volcano effect" is observed, which is a visible rising of the steel/slag mixture beneath the ladle shroud 12, which is a tube that effectively communicates the bottom of the ladle 104 with the tundish 106. As shown in the FIGURE, the ladle shroud 12 actually empties the molten steel 102 flowing through it under the tundish slag layer 108. From the tundish 106, the molten steel flows out the bottom of the tundish 106 into a mold 110, from which the steel, which has begun to solidify, is drawn into its final shape. It is noted in passing that the ladle shroud 12 shown in FIG. 1 shows the ladle shroud 12 as modified by the present invention.

Various automatic slag detection devices have been tried in the past and some of these are commercially used to detect the ladle slag 100 exiting the ladle 104. These devices use a combination of electromagnetic coils that differentiate between the electrical properties of the ladle slag 100 and the molten steel 102. The sensor coils are either installed around the o bottom of the ladle 104 or in the plates of the slidegate which controls the flow of molten steel 102 from the ladle 104 into the tundish 106. These electromagnetic devices appear to work well, but are very expensive to purchase and require constant maintenance for optimal performance. Even further, the very positioning of these devices in association with a ladle 104 or the slidegate results in the devices being incorporated into an expensive piece of equipment that is not readily available for maintenance.

The ladle slag detector 14 of the present invention uses a simple one-wire sensor 16 mounted in the ladle shroud 12 communicating the ladle outlet and the tundish 106. The sensor 16 detects an electrochemical voltage generated by the slag that differentiates the slag from the molten metal. The detection of the slag in the shroud 12 is used to trigger an alarm means, such as a horn to warn the operator of the presence of slag and to automatically close the ladle slidegate to stop flow from the ladle into the ladle shroud. In one example, the alarm means would sound when the electrochemical voltage exceeds a predetermined setpoint.

The ladle shroud 12 used in the ladle slag detector 14 of the present invention may be any of a variety of ladle shrouds commercially available, but a preferred ladle shroud 12 is produced by Vesuvius USA Corporation of Naperville, Ill. A preferred material for such a ladle shroud 12 is an alumina/graphite that is electrically conductive. As is seen in FIG. 1, the ladle shroud 12 is typically a hollow cylinder which narrows slightly from the top to the bottom. The preferred Vesuvius ladle shroud is typically 1520 mm high (59.8 inches), has a top outer diameter of 220 mm (8.67 inches), a top inner diameter of 124 mm (4.88 inches). The bottom outside diameter is typically 160 mm (6.30 inches) and the bottom inside diameter is typically 105 mm (4.13 inches). Based on these bottom sizes, the thickness of the side wall 18 of the ladle shroud 12 is about 27.5 mm (1.08 inches).

The sensor 16 is positioned in the side wall 18 of the ladle shroud 12 by boring a hole 20 through the wall 18. A typical hole 20 would be about 0.3125 inches in diameter, and would be positioned about 22 inches from the bottom of the ladle shroud 12, that is, about one-third of the distance between the bottom to the top of the shroud height. An cylindrical insulating sleeve 22, preferably a non-conductive ceramic and preferably comprising mullite, is inserted into the hole 20, typically from the inside, where it is secured in place by a frictional fit, an appropriate ceramic cement, or both. The insulating sleeve 22 has a central aperture therethrough of approximately 0.1875 inches. The sleeve 22 has a cylindrical portion 24 slightly longer than the thickness of the ladle shroud side wall 18. The sleeve 22 also has an enlarged flange portion 26 at one end thereof, to prevent the ranged end of the sleeve from actually passing through the hole 20. Inserted into the insulating sleeve 22 is a conductive pin 28. The conductive pin 28 is typically a steel material that is also cylindrical, preferably with an outer diameter along a cylindrical portion 30 that is closely sized to the inside diameter of the central aperture through the insulating sleeve 22. The cylindrical portion will be approximately the same length as the side wall thickness. Typically, this will be 0.1875 inches. As with the insulating sleeve, one end has a flange portion 32, in this case to prevent the ranged end of the conductive pin 28 from passing through the central aperture in the insulating sleeve 22. The opposite end will typically have a central bore 34 made therein, the bore being typically 0.125 inches in diameter and 0.25 inches deep into the cylindrical portion 30. The ranged end 32 will be exposed to the molten steel in the ladle shroud, and a significant portion of it may melt during its exposure to the molten steel. The bore 34 is intended to accommodate having a lead wire 36 attached to it, the lead wire being attached to a voltmeter 38 to measure the difference in the electrochemical potential between the inside of the ladle shroud and a ground potential 40. Methods for attaching the lead wire 36 in the bore will be readily known to the person of ordinary skill in the art, and can include a variety of techniques, from brazing or soldering to the use of clips of pins. It will be easily understood that the conductive pin 28 will be electrically communicated to the molten steel and slag flowing through the ladle shroud. As slag enters the ladle shroud and nears the conductive pin 28, the electrical potential at the conductive pin will suddenly change, reflecting the electrochemical potential difference existing between the molten steel and the slag. This difference will be readily observed in the voltmeter reading.

Figure 2:
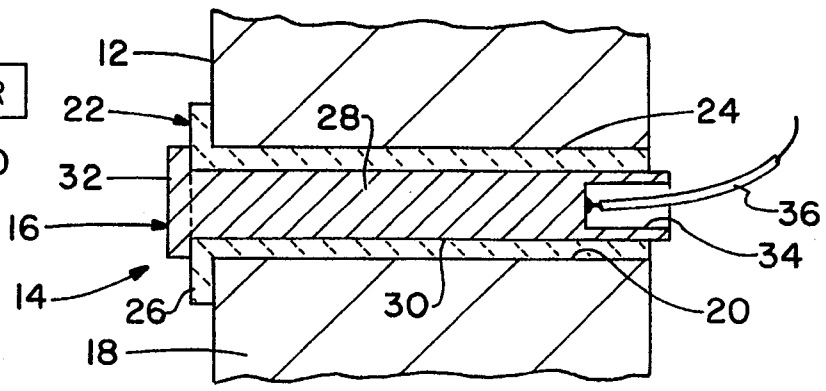
FIG. 2 is an enlarged section of the ladle shroud showing the conducting pin and the insulating sleeve.
Figure 3:
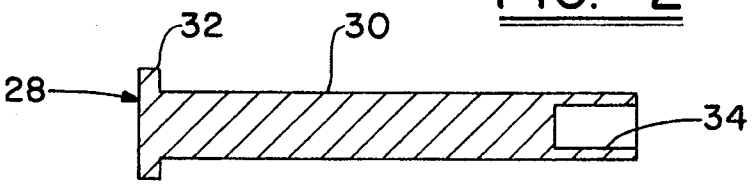
FIG. 3 is a sectional view of the conducting pin.
Figure 4:
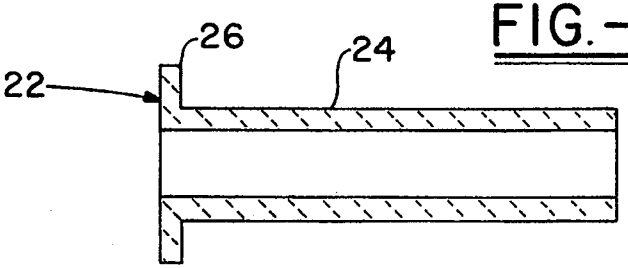
FIG. 4 is a sectional view of the insulating sleeve.

The sensor 16, comprising the insulating sleeve 22, the conductive pin 28 and the lead wire 36, is shown in enlarged sectional view in FIG. 2. The conducting pin and the lead wire 36 are shown in sectional view in FIG. 3. The insulating sleeve is shown in sectional view in FIG. 4.

In usual mill practice, the ladle shroud 12 is replaced every time the tundish is replaced, which occurs approximately once per shift. Because the sensor system taught in the present invention is so easily and inexpensively installed in the ladle shroud, the entire ladle shroud and sensor system can be discarded regularly whenever the ladle shroud needs to be replaced. In this way, the present invention exemplifies cost savings that are totally different from those possible with the electromagnetic systems known in the prior art.

While the preferred embodiment and the best mode presently known have been taught to comply with the requirements of United States Patent Laws, the scope of the present invention is not to be measured by the foregoing specification, but is instead to be determined from the attached claims, which are made a part hereof.

What is claimed is:

1. A device for detecting slag in molten metal, said device comprising:

a means for comparing the electrical potential of the molten metal to a ground potential;

a ladle shroud having a hollow passage therethrough for communicating a ladle containing the molten metal to a tundish to allow said molten metal to flow from said ladle to said tundish; and an electrically conductive element positioned in a wall of said hollow passage, said element in electrical contact with said molten metal and communicated to said comparing means.

2. The device of claim 1 wherein the ladle shroud is electrically conductive and the electrically conductive element is electrically isolated therefrom by an insulating sleeve therearound.

3. The device of claim 1 wherein the electrically conductive element is a steel pin.

4. The device of claim 3 wherein the steel pin has an end in electrical contact with said molten metal.

5. The device of claim 4 wherein said end in electrical contact is flanged to increase electrical contact area with the molten metal.

6. An improved ladle shroud for a continuous molten metal caster having a means for comparing a voltage of the molten metal against a ground voltage, said ladle shroud having a hollow passage therethrough communicating a ladle containing a molten metal to a tundish to allow said molten metal to flow from said ladle to said tundish, wherein the improvement comprises an electrically conductive element positioned in a wall of said hollow passage, said element in electrical contact with said molten metal and with said voltage comparing means.

7. The improved ladle shroud of claim 6 wherein the ladle shroud is electrically conductive and the electrically conductive element is electrically isolated therefrom by an insulating sleeve therearound.

8. The improved ladle shroud of claim 6 wherein the electrically conductive element is a steel pin.

9. The improved ladle shroud of claim 8 wherein the steel pin has an end in electrical contact with said molten metal.

10. The improved ladle shroud of claim 9 wherein said end in electrical contact is flanged to increase electrical contact area with the molten metal.

11. A method of detecting slag in molten metal flowing from a ladle into a tundish, said method comprising the steps of:

a). passing said molten metal through a ladle shroud having a hollow passage therethrough, said ladle shroud having an electrically conductive element positioned in a wall of said hollow passage, and said element being in electrical contact with said molten metal;

b). communicating an electrical potential of said molten metal to a means for comparing said electrical potential to a ground potential;

c). observing the electrical potential measurement for a sudden and abrupt change when said slag enters the ladle shroud near the electrically conductive element.

* * * * *